US005823451A

United States Patent [19]

Sharpe

[11] Patent Number: 5,823,451

[45] Date of Patent: Oct. 20, 1998

[54] MEDICATION CRUSHING DEVICE

[75] Inventor: Gary L. Sharpe, Circleville, Ohio

[73] Assignee: Health Care Logistics, Inc., Circleville, Ohio

[21] Appl. No.: 746,814

[22] Filed: Nov. 18, 1996

[51] Int. Cl.[6] ..... B02C 19/08

[52] U.S. Cl. ..... 241/169.2; 241/DIG. 27

[58] Field of Search ..... 241/168, 169, 241/169.1, 169.2, 199.8, 199.9, 199.11, 199.12, DIG. 27

[56] References Cited

U.S. PATENT DOCUMENTS

| | | | |
|---|---|---|---|
| 1,488,276 | 3/1924 | O'Brien et al. | 242/169 X |
| 2,631,786 | 3/1953 | Morgan | 241/161 |
| 3,915,393 | 10/1975 | Elkins | 241/168 |
| 4,003,523 | 1/1977 | Doolittle | 241/169.2 |
| 4,092,005 | 5/1978 | Benroth | 241/168 |
| 4,121,775 | 10/1978 | Roseberg et al. | 241/DIG. 27 X |
| 4,341,356 | 7/1982 | Hiott et al. | 241/169.2 |
| 4,694,996 | 9/1987 | Siegel | 241/DIG. 27 X |
| 4,763,847 | 8/1988 | Vosburgh | 241/169 |
| 4,967,971 | 11/1990 | Smith | 241/169 |
| 5,118,021 | 6/1992 | Fiocchi | 241/DIG. 27 X |

FOREIGN PATENT DOCUMENTS

| | | | |
|---|---|---|---|
| 94/03091 | 2/1994 | WIPO | 241/169.2 |

*Primary Examiner*—Mark Rosenbaum
*Attorney, Agent, or Firm*—Kremblas, Foster, Millard & Pollick

[57] ABSTRACT

A device for crushing medication and the like between a crushing cup and a medication cup, with the device including a base member, a upright member, and a crushing arm pivotally movable with respect to the upright member, with the crushing arm having a crushing element mounted therewith. The base member has an upper surface, a lower surface, a first end surface, a second end surface, and a recessed portion. The recessed portion has a first dimension corresponding to its length and a second dimension corresponding to its width, with the first dimension being greater than the second dimension. The upright member has a first ear portion and a second ear portion, with each ear portion having a top surface. The upright member also has an additional intermediate top surface located between the top surfaces of the ear portions and the base member. The crushing arm is pivotally movable with respect to the upright member until the first end of the crushing arm contacts the intermediate top surface.

20 Claims, 6 Drawing Sheets

MEDICATION CRUSHING DEVICE

TECHNICAL FIELD

The present invention relates generally to the crushing of tablet medication, and more particularly to a device for crushing tablet medication which uses medication and crushing cups.

BACKGROUND OF THE INVENTION

It is sometimes desirable to crush or pulverize medication so as pills or tablets to place such medication in a more suitable form for ingestion. For example, some individuals experience difficulty in swallowing whole pills or tablets. This is more pronounced with the elderly and the very young. In other cases, a crushed pill or tablet can be more rapidly assimilated through the stomach into the blood stream than a whole pill. Furthermore, in cases involving gastric or naso-gastric feeding by means of a tube, an intact pill or tablet cannot be taken: it must be administered after crushing. Finally, some pills and tablets leave an aftertaste which can be minimized by mixing the pill or tablet in powdered form in a beverage or soft food such as applesauce.

For centuries, mortar and pestle units of various designs have been used to crush tablets. The standard mortar and pestle can experience one or more problems. For example, a tablet or portion of a tablet may escape from the bowl-shaped mortar. This causes obvious problems with contamination as well as dosage control. Another problem occurs when the ground powder sticks to the inside surface of the mortar, thus needing to be scraped out of the bowl. This takes additional time and effort, and results in a reduced dosage of medication unless all the fragments of powder are removed.

Attempts have been made to overcome the aforesaid drawbacks associated with the conventional mortar and pestle. One proposed solution utilizes paper cups and a hammering tool. In this method, the tablet to be crushed is placed in a paper cup and the sides of the cup are then folded over so as to cover and contain the tablet. Striking the folded cup with the tool effectively crushes the tablet. However, problems still exist. First, a paper cup can be torn or perforated by this process. Secondly, since the crushed tablet normally must be transferred for ingestion to a second, new and unused pill cup or to some other form of tablet dispenser, the presence of any torn, perforated or disfigured paper in the cup can make it difficult to pour the tablet powder from the original cup, not to mention the fact that there are potential problems with the powder falling through any holes in the sides or sticking to the sidewalls of the cup. All these problems adversely affect dosage and the medical professional's efficient use of time.

Still another proposed solution to the problem has been to crush a tablet between bowl portions of adjacent spoons, wherein the underside of one spoon is placed on top of a tablet and pushed into the bowl portion of the second spoon so as to crush the tablet. Of course, it should be realized that there is a strong potential that some of the powdered medication may spill over the sides of the spoon, thus adversely affecting the dosage. Additionally, the individual performing the crushing has to have sufficient hand strength to provide adequate crushing power.

The Morgan patent, U.S. Pat. No. 2,631,786, discloses a tablet crusher having a handle pivotally attached to an upwardly extending foot at the end of a lower plate. Following crushing, a closure member is withdrawn from the side of the bottom plate permitting the crushed powder to drop through a hole in the bottom of the device's plate. This device assumes that none of the tablet will remain on the closure member as it is withdrawn from the side of the base plate. It also assumes that the unit can be easily cleaned to preclude problems related to contamination and cross-contamination.

The Hiott, et al patent, U.S. Pat. No. 4,341,356, discloses a pulverizer having a holder shaped to fit within a hole in the device's base and a pulverizer shaped to fit within the holder. The amount of downward force that can be generated by this device may be less than desirable due to the inability to obtain strong leverage. Additionally, problems with contamination can only be avoided by cleaning both the pulverizer and the holder prior to a subsequent crushing operation, which is time consuming.

The Doolittle patent, U.S. Pat. No. 4,003,523, discloses a portable tablet or pill grinder having two embodiments. In each case, the tablets to be crushed are placed inside a bowl-shaped component and acted upon by another component of the grinder which comes into direct contact with the medication. Thus, prior to a subsequent crushing operation, the device, or at least the components which come into direct contact with the medication, must be cleaned to avoid the potential for contamination, which is time consuming.

The Elkins patent, U.S. Pat. No. 3,915,393, discloses a medication crushing apparatus which attempts to overcome the problems with contamination by the use of a pair of cups. Its design bears some similarities to the devices disclosed in both the Doolittle and Morgan patents.

However, problems still exist in pill or tablets crushers currently available. Some of these problems relate to the appearance of the pill or tablet crusher after repeated cleanings. Due to concerns about contamination, it is highly recommended, if not mandated, that these devices be subjected to cleaning in an autoclave. A substantial number of prior art devices tend to pit after having been subjected to numerous cleaning procedures. This is, of course, both unattractive, and a possible source of contamination. Additional problems have been experienced in connection with these devices due to breakage given the forces to which the device is subjected.

It is thus apparent that the needs exist for a device for crushing pills or tablets which overcomes the problems with the prior art. It should be appreciated that such a device should minimize problems with contamination as well as permit the efficient and effective utilization of such a device.

SUMMARY OF THE INVENTION

There is disclosed a device for crushing medication and the like between a medication cup and a crushing cup, with the device having a base member, an upright member, and a crushing arm pivotally movable with respect to the upright member. The base member is secured to the upright member. In addition, the base member has formed therein a recessed portion. Furthermore, the crushing arm has a crushing element mounted therewith. Preferably the crushing element is detachably mounted to the crushing arm.

The base member has an upper surface, a lower surface, a first end surface and a second end surface, with the upper surface extending between the first end surface and the second end surface. Furthermore, the upright member is located between the first end surface and the recessed portion. Still further, the recessed portion is located between the upper surface and the lower surface. Preferably, the recessed portion has a first dimension corresponding to its length and a second dimension corresponding to its width, with the first dimension being greater than the second dimension.

In the preferred form of the embodiment, the upright member comprises a first ear portion and a second ear portion, with each ear portion having a top surface, and the upright member having an additional intermediate top surface located between the top surfaces of the ear portions and the base member. The crushing arm is pivotally movable with respect to the upright member until the first end of the crushing arm contacts the intermediate top surface.

The crushing arm has a recessed area formed therein, with the crushing element being retained in the recessed area. Preferably the crushing element is frictionally retained in the recessed area. In addition to having a first end, the crushing arm has a lower surface portion, with a bevelled surface directly adjacent the first end.

There is also disclosed a device for crushing medication and the like between a medication cup and a crushing cup, with the device including a base member having formed therein a recessed portion, with the base member also having an upper surface, a lower surface, a first end surface and a second end surface. The upper surface extends between the first end surface and the second end surface. The recessed portion is located between the upper surface and the lower surface. Preferably, the recessed portion has a first dimension corresponding to its length and a second dimension corresponding to its width, with the first dimension being greater than the second dimension.

The device also includes an upright member secured to the base member and located between the first end surface and the recessed portion. The upright member has a first ear portion and a second ear portion, each ear portion having a top surface, with the upright member having an additional intermediate top surface, located between the top surfaces of the ear portions and the base member.

The device also includes a crushing arm pivotally movable with respect to the upright member, with the crushing arm having a crushing element mounted therewith. The crushing arm is pivotally movable with respect to the upright member until the first end of the crushing arm contacts the intermediate top surface. The crushing arm preferably has a recessed area formed therein, with the crushing element being detachably retained in the recessed area. Extending between the lower surface of the crushing arm and the first end of the crushing arm is a bevelled surface, with the bevelled surface being directly adjacent the first end.

There is also disclosed a device for crushing medication and the like between a medication cup and a crushing cup, with the device having a base member having formed therein a recessed portion in addition to having an upper surface, a lower surface, a first end surface and a second end surface, with the upper surface extending between the first end surface and the second end surface, and with the recessed portion located between the upper surface and the lower surface, and with the recessed portion having a first dimension corresponding to its length and a second dimension corresponding to its width, with the first dimension being greater than the second dimension.

The device also includes an upright member secured to the base member, with the upright member located between the first end surface and the recessed portion. The upright member has a first ear portion and a second ear portion, each ear portion having a top surface. In addition, the upright member has an intermediate top surface located between the top surfaces of the ear portions and the base member.

The device also has a crushing arm having a first end and a lower surface portion. The crushing arm is pivotally movable with respect to the upright member until the first end contacts the intermediate top surface of the upright member. Extending between the lower surface of the crushing arm and the first end of the crushing arm is a bevelled surface, with the bevelled surface being directly adjacent the first end.

One aspect of this invention is to provide a device for crushing medication which precludes problems with contamination. An attendant advantage associated with elimination of contamination is the reduction in oversight required by medical or pharmaceutical personnel in view of increasing regulatory control directed to eliminating contamination.

Yet another aspect of this invention is to provide a device for crushing medication which is more durable than many of those associated with the prior art.

Other aspects and advantages of the instant invention will be appreciated from the following description, drawings, examples, and the appended claims.

DETAILED DESCRIPTION OF THE INVENTION

Figure 1:
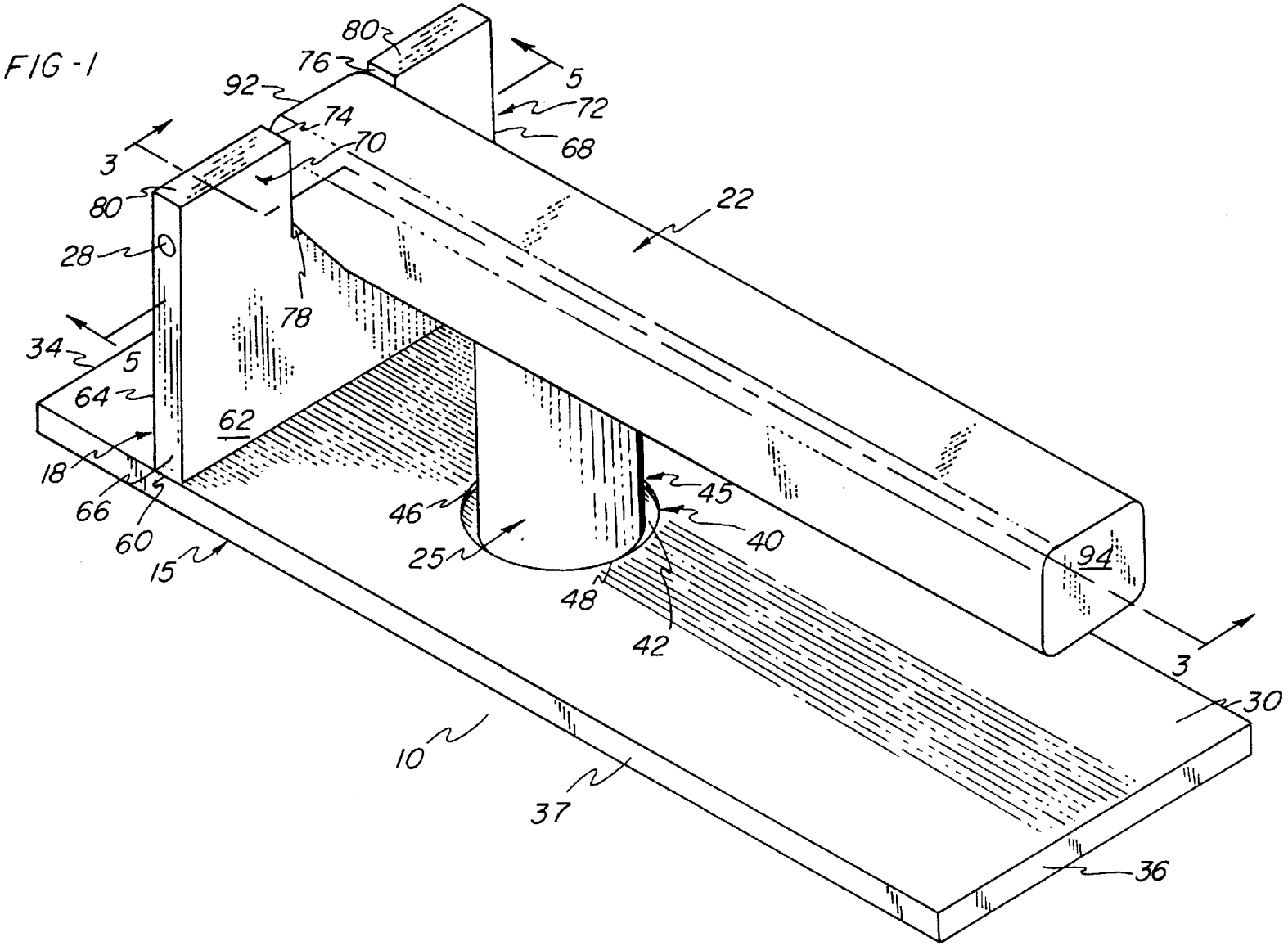
FIG. 1 discloses a perspective view of a medication crushing device embodying the invention.
Figure 2:
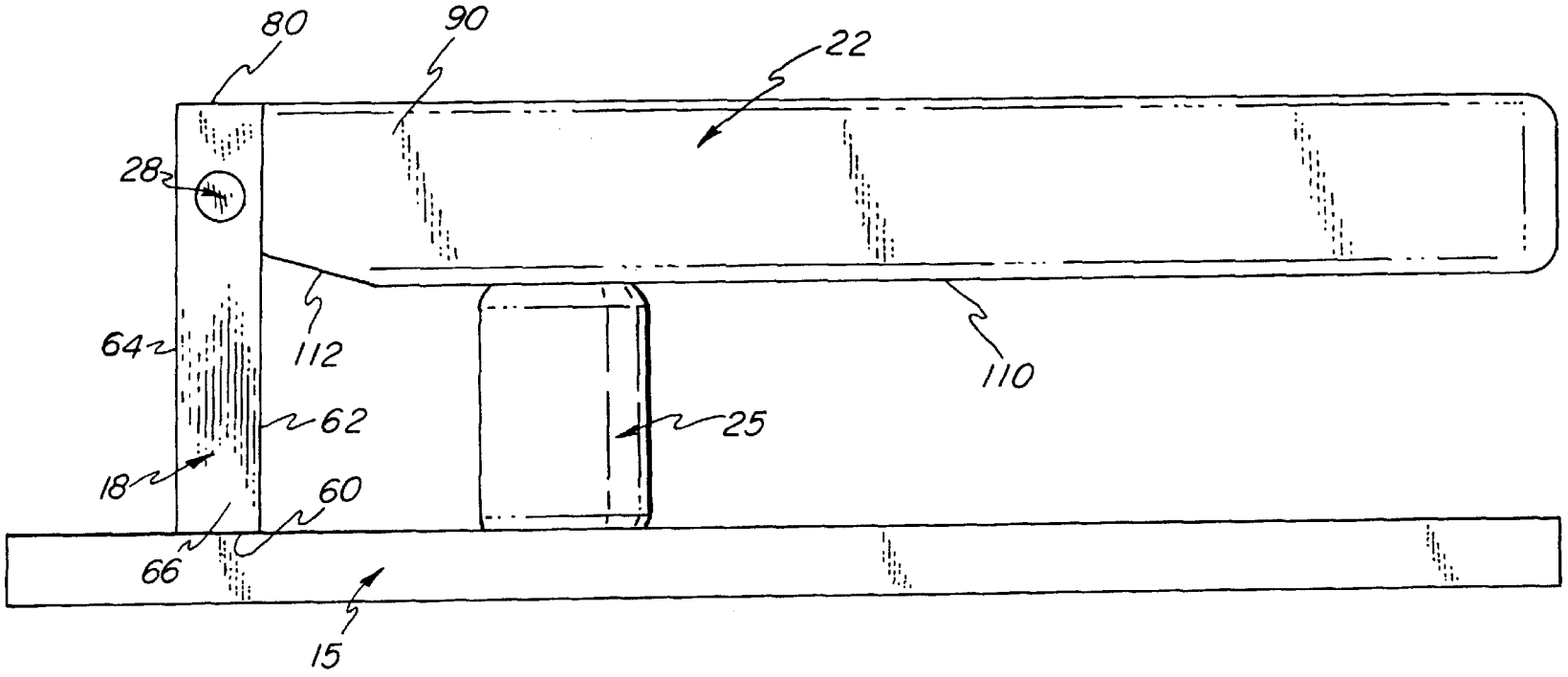
FIG. 2 discloses a front elevational view of FIG. 1.

Having reference to the drawings, attention is directed first to FIG. 1 which shows the medication crushing device associated with this present invention generally disclosed by the numeral 10. The tablet crusher 10 has as its basic components a base member 15, an upright member 18, a crushing arm 22, a crushing element 25, and pin 28. Preferably, these components are made of stainless steel, so that they can be autoclaved.

The base member 15 can be better appreciated from a comparison of FIGS. 1, 2, 3, 4, and 5. In the embodiment shown here, the base member 15 is of a rectangular shape, with an upper surface 30, and a lower surface 32, both of which are preferably planar. Additionally, the base member 15 has a first end surface 34 and a second end surface 36, both of which are preferably planar and parallel to each other. The upper surface extends between the first end surface and the second end surface. Furthermore, the base member 15 preferably has a pair of side surfaces 37.

The dimensions of the preferred embodiment of the base member 15 are as follows. It is 9" long by 2.5" wide, with the height of the end surfaces and side surfaces being 0.375". Two base plate connector channels 38 are centered 1.25" from the first end surface 34 of the base member 15. The centers of the base plate connector channels are spaced 1.5" from each other, such that each center of each base plate connector channel is spaced 0.5" from its respective side surface 37. Each base plate connector channel 38 has an upper portion 39*a* and a lower portion 39*b*, both of which are disc-shaped. The upper portion 39*a* has a height of 0.125" and a radius of 0.25". Meanwhile, the lower portion 39*b* has a height of 0.25" and a radius of 0.5".

A recessed portion 40 can best be appreciated from a consideration of FIGS. 1, 3, 4, 7, which shows this relatively shallow recess in the upper surface 30. The recessed portion 40 is shown being located between and parallel to both the upper surface and the lower surface. The recessed portion is oblong in shape, having foci spaced 0.437" apart, with each foci having associated therewith a radius of 0.625". Thus, the recessed portion 40 has a first dimension corresponding to its length and a second dimension corresponding to its width, with the first dimension being greater than the second dimension. The recessed portion 40 is preferably 0.125" deep, having a base 42 and a sidewall 45. The first end or proximal end 46 of the recessed portion 40 is the one which is closer to the first end surface 34, while the second end or distal end 48 of the recessed portion 40 is closer to second end surface 36.

Figure 3:
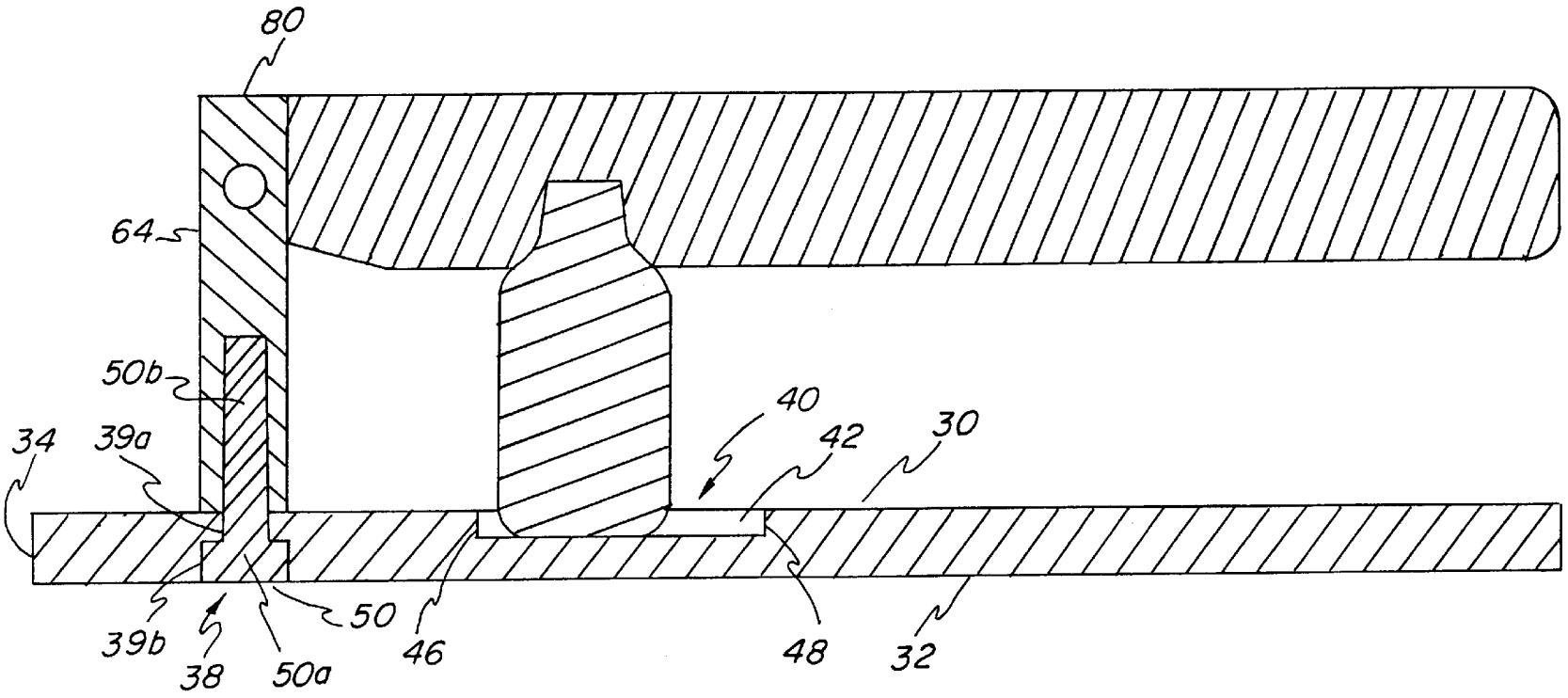
FIG. 3 discloses a vertical sectional view taken along line 3—3 of FIG. 1.
Figure 4:
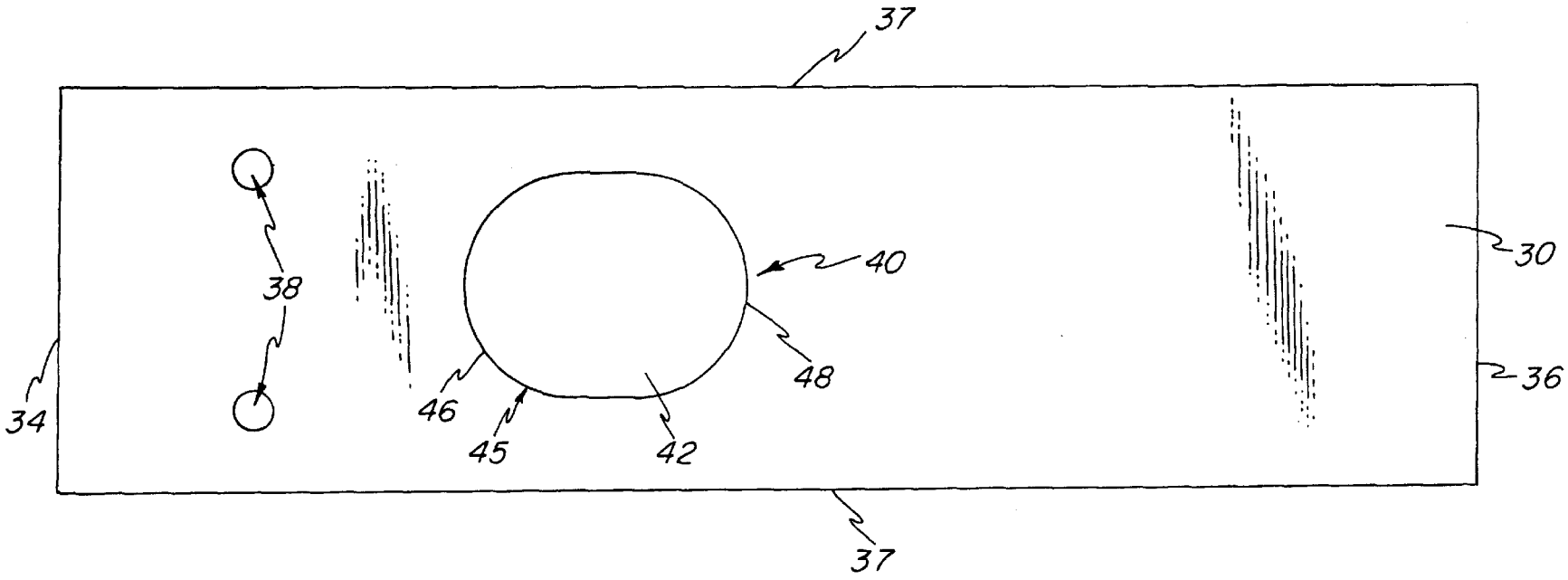
FIG. 4 discloses a top plan view of the invention.
Figure 5:
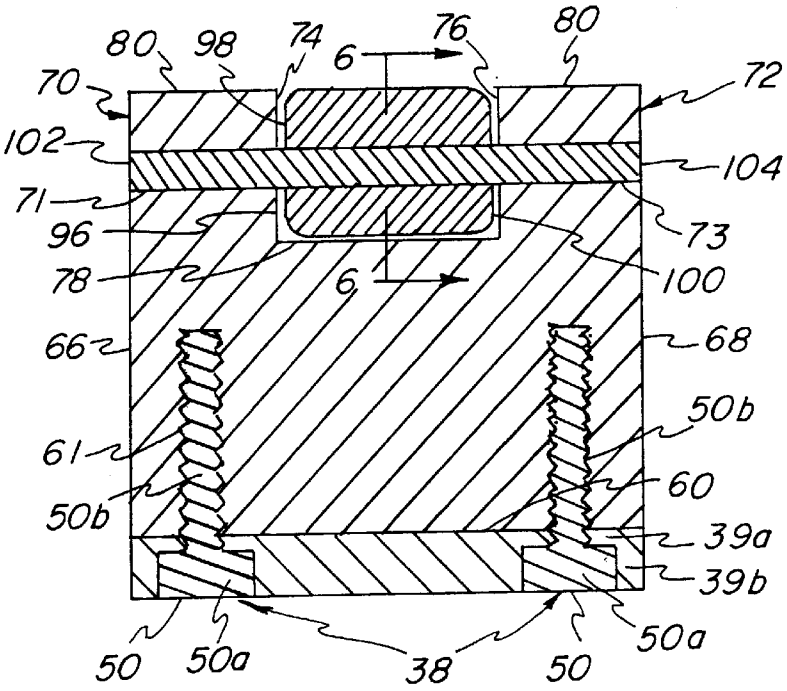
FIG. 5 discloses a vertical section view taken along line 5—5 of FIG. 1.

Turning now to a comparison of FIGS. 3 and 5 permit an understanding of how the base member 15 is secured to the upright member 18. It will be appreciated that a fastener 50 secures the two together. Fastener 50 comprises a head 50*a* and a fastening component 50*b*, and preferably is either a flat-headed bolt or a metal screw configured to fit snugly into the base plate connector channels 38.

Next, a comparison of FIGS. 1, 2, 3, 5, and 7 permits an understanding of the structure of the upright member 18 which is shown as being located between the first end surface 34 and the recessed portion 40. The upright member 18 has a bottom surface 60, preferably planar, having a plurality of fastener channels 61 extending upwardly therethrough. Preferably there is just a pair of these fastener channels 61, with their diameter being such that the fastening component 50*b* is held securely therein.

The upright member 18 also has a first sidewall 62 and a second sidewall 64, both preferably planar and parallel to one another. The first sidewall 62 faces the recessed portion 40, while the second sidewall 64 faces the first end surface 34. Additionally, the upright member has a first edge 66 and a second edge 68, both preferably planar and parallel to one another. The upright member also includes a first ear portion 70 with a first ear channel 71, and a second ear portion 72 with a second ear channel 73. The first ear portion 70 has a first ear portion inner edge 74, while the second ear portion has a second ear portion inner edge 76. The two inner edges are preferably parallel to one another. The upright member has an additional intermediate top surface 78 located between the ear portions top surfaces 80 and the juncture of the bottom 60 with the base member 15.

In the preferred embodiment of the invention, the height of the upright member is 2.375", its width is 2.5", and its thickness is 0.5". Each ear portion is 0.75" wide, such that the first ear portion inner edge 74 is spaced 1" apart from the second ear portion inner edge 76.

The structure of the crushing arm 22 can be appreciated from a comparison of FIGS. 1, 2, 5, 6, and 7, wherein rod 22 is shown having an outer surface 90. While a vertical cross-section of the rod would disclose a circle, the rod 22 preferably has a rod first end 92 which is flattened, and a rod second end 94 which is rounded. Preferably the rod is 8" in length, and 1" in diameter. Rod aperture 96 has its center spaced 0.25" from the rod first end 92, and 0.5" below the top surface of the rod. The diameter of rod aperture 96 is also 0.25".

Adjacent the first ear portion inner edge is rod first side surface portion 98. Adjacent the second ear portion inner edge is rod second side surface portion 100. Similarly, directly adjacent the first edge 66 is pin first end 102, and directly adjacent the second edge 68 is pin second end 104, with the pin first end 102 and pin second end 104 being the opposite ends of pin 28.

Figure 6:
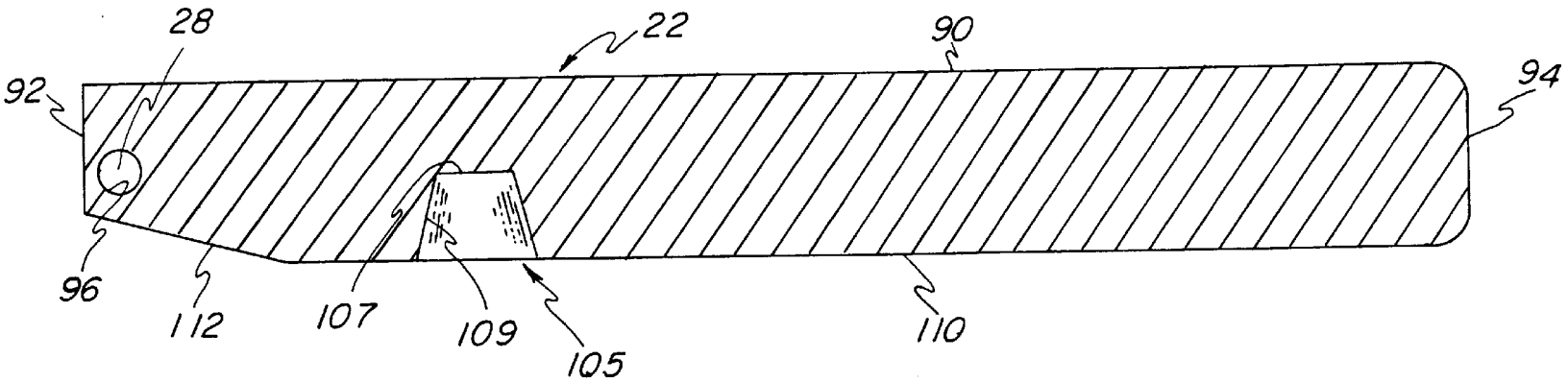
FIG. 6 discloses a vertical sectional view taken along line 6—6 of FIG. 5.

As shown in FIG. 6, rod recess 105, with its recessed top surface 107 and tapered recess sidewall 109, extends upwardly from rod lower surface portion 110. The recessed top surface has a diameter of 0.375" and is located 0.5" from the rod lower surface portion 110. At the rod lower surface portion itself, the rod recess has a diameter of 0.5". Crushing element 25 is generally cylindrical with a height of 2" and a diameter of 1". The upper neck portion of the crushing element 25 is formed so that it can be pressed taper fit into the rod recess 105.

Comparing FIGS. 1, 2, 6, and 7 discloses a bevelled surface 112 which extends upwardly from the rod lower surface portion 110 towards the rod first end 92. The bevelled surface extends 1.125" in from the rod first end 92 at an angle θ of 12° from the rod lower surface portion.

Figure 7:
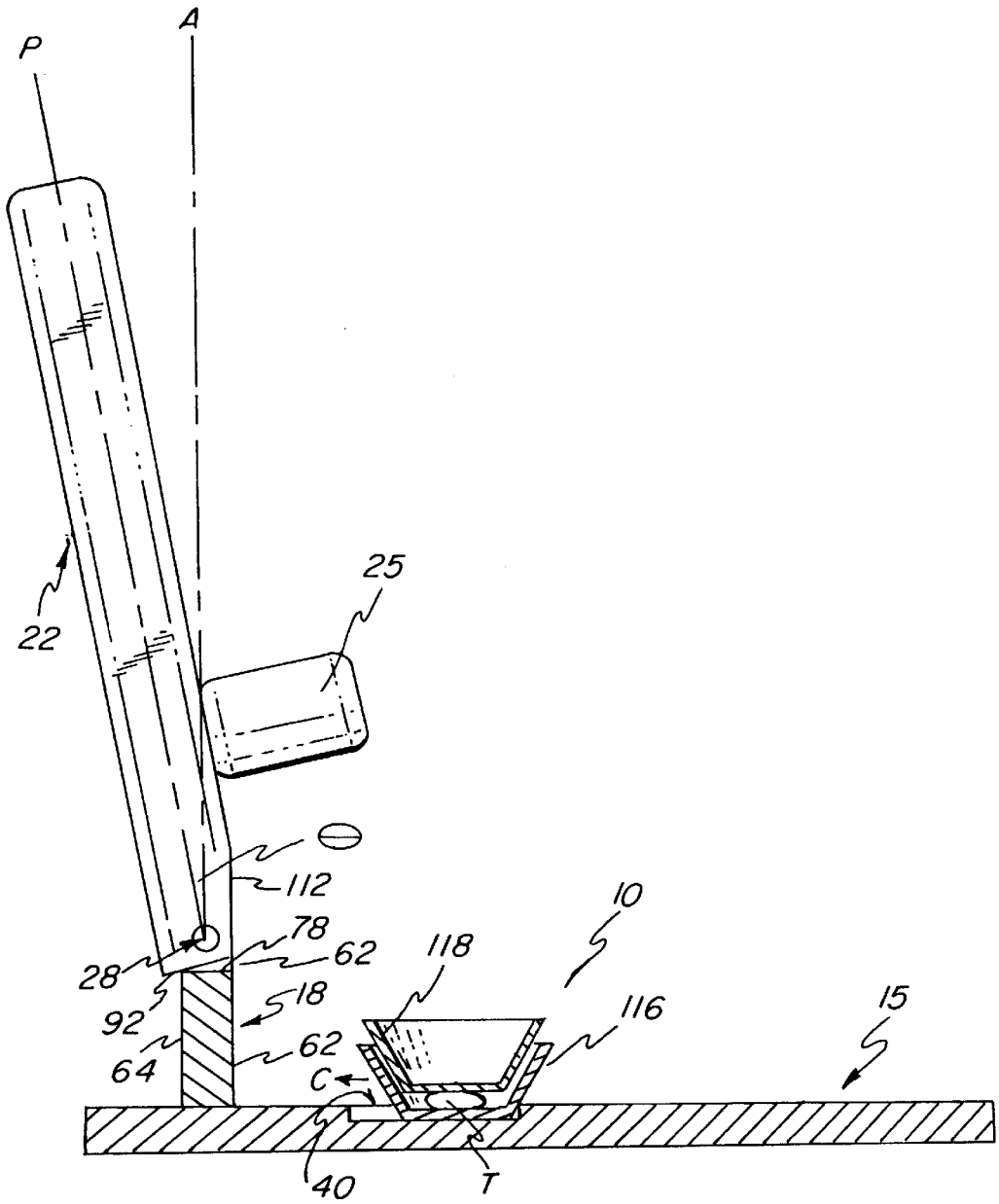
FIG. 7 discloses an elevational view, taken partly in cross-section, of the device of this invention in actual use.

The medication crushing device of this invention in actual use is shown in FIG. 7, with crushing element 25 frictionally held within rod recess 105. As shown, the medication or tablet, T, is placed into a medication cup 116 and a crushing cup 118 is placed into the medication cup so as to cover the tablet. Crushing arm 22, with its resting position having its center axis along rest position axis, P, as opposed to the vertical axis, A, is pivoted about pin 28, so that crushing element 25 is lowered into the crushing cup 118. In its resting position, the first end of the rod 92 contacts the intermediate top surface 78 of the upright member. As additional downward pressure is applied, tablet T is crushed between the crushing cup and the medication cup. Additionally, as the crushing element comes into contact with the crushing cup, the cups move in the direction of crushing displacement C towards the first end 46 of the recessed portion 40.

The present invention thus provides a device for crushing medication which precludes problems with contamination. It is easily cleaned due to its being made of stainless steel. An attendant advantage associated with the elimination of contamination is the reduction in oversight required by medical or pharmaceutical personnel. This is especially true in view of the increasing regulatory control directed to eliminating contamination. Finally, the medication crushing device of this invention is more durable than many of those associated with the prior art.

While the medication crushing device herein described constitutes the preferred embodiment of the invention, it is to be understood that the invention is not limited to this precise form of medication crushing device and that changes may be made therein without departing from the scope of the invention which is defined in the appended claims.

What is claimed is:

1. A device for crushing medication between a medication cup and a crushing cup, said device comprising a base member, said base member having formed therein a recessed portion, an upright member secured to said base member, said upright member comprising a first ear portion and a second ear portion, each ear portion having a top surface, said upright member having an additional intermediate top surface, said intermediate top surface located between the top surfaces of the ear portions and said base member, and a crushing arm pivotally movable with respect to said upright member, said crushing arm having a crushing element mounted therewith, said crushing arm having a lower surface portion, a first end, and a bevelled surface extending upwardly from said lower surface portion to said first end.

2. The device according to claim 1 wherein said crushing element is detachably mounted to said crushing arm.

3. The device according to claim 1 wherein said base member has an upper surface, a lower surface, a first end surface and a second end surface, said upper surface extending between said first end surface and said second end surface, said upright member located between said first end surface and said recessed portion, said recessed portion located between said upper surface and said lower surface.

4. The device according to claim 1 wherein said recessed portion has a first dimension corresponding to its length and a second dimension corresponding to its width, said first dimension being greater than said second dimension.

5. The device according to claim 1 wherein said crushing arm has a recessed area formed therein, said crushing element being retained in said recessed area.

6. The device according to claim 5 wherein said crushing element is frictionally retained in said recessed area.

7. A device for crushing medication between a medication cup and a crushing cup, said device comprising a base member, said base member having formed therein a recessed portion, an upright member secured to said base member, said upright member having an intermediate top surface, and a crushing arm pivotally movable with respect to said upright member, said crushing arm having a first end, said crushing arm being pivotally movable with respect to said upright member until said first end contacts said intermediate top surface, said crushing arm having a crushing element mounted therewith, said crushing arm having a lower surface portion, a first end, and a bevelled surface extending upwardly from said lower surface portion to said first end.

8. The device according to claim 7 wherein said crushing element is detachably mounted to said crushing arm.

9. The device according to claim 7 wherein said base member has an upper surface, a lower surface, a first end surface and a second end surface, said upper surface extending between said first end surface and said second end surface, said upright member located between said first end surface and said recessed portion, said recessed portion located between said upper surface and said lower surface.

10. The device according to claim 7 wherein said recessed portion has a first dimension corresponding to its length and a second dimension corresponding to its width, said first dimension being greater than said second dimension.

11. The device according to claim 7 wherein said crushing arm has a recessed area formed therein, said crushing element being retained in said recessed area.

12. The device according to claim 11 wherein said crushing element is frictionally retained in said recessed area.

13. A device for crushing medication between a medication cup and a crushing cup, said device comprising a base member, said base member having formed therein a recessed portion, said base member having an upper surface, a lower surface, a first end surface and a second end surface, said upper surface extending between said first end surface and said second end surface, an upright member secured to said base member, said upright member located between said first end surface and said recessed portion, said upright member having a first sidewall which faces said recessed portion and a second sidewall which faces said first end surface and a crushing arm pivotally movable with respect to said upright member, said crushing arm having a crushing element mounted therewith, said crushing arm having a lower surface portion, a first end, and a bevelled surface extending upwardly from said lower surface portion to said first end.

14. The device according to claim 13 wherein said crushing arm has a recessed area formed therein, said crushing element being detachably retained in said recessed area.

15. The device according to claim 13 wherein said recessed portion is located between said upper surface and said lower surface.

16. The device according to claim 13 wherein said recessed portion has a first dimension corresponding to its length and a second dimension corresponding to its width, said first dimension being greater than said second dimension.

17. The device according to claim 13 wherein said upright member comprises a first ear portion and a second ear portion, each ear portion having a top surface, said upright member having an additional intermediate top surface, said intermediate top surface located between the top surfaces of the ear portions and said base member.

18. The device according to claim 13 wherein said upright member has an intermediate top surface and said crushing arm has a first end, said crushing arm being pivotally movable with respect to said upright member until said first end contacts said intermediate top surface.

19. The device according to claim 13 wherein said crushing arm has a first end and a lower surface portion, said crushing arm having a bevelled surface directly adjacent said first end.

20. A device for crushing medication between a medication cup and a crushing cup, said device comprising a base member, said base member having formed therein a recessed portion, said base member having an upper surface, a lower surface, a first end surface and a second end surface, said upper surface extending between said first end surface and said second end surface, said recessed portion located between said upper surface and said lower surface, said recessed portion having a first dimension corresponding to its length and a second dimension corresponding to its width, said first dimension being greater than said second dimension, an upright member secured to said base member, said upright member located between said first end surface and said recessed portion, said upright member having a first sidewall which faces said recessed portion and a second sidewall which faces said first end surface, said upright member comprising a first ear portion and a second ear portion, each ear portion having a top surface, said upright member having an additional intermediate top surface, said intermediate top surface located between the top surfaces of the ear portions and said base member, and a crushing arm, said crushing arm having a first end, said crushing arm being pivotally movable with respect to said upright member until said first end contacts said intermediate top surface , said crushing arm having a lower surface portion and a bevelled surface, said beveled surface extending upwardly from said lower surface portion to said first end.

* * * * *